US005431986A

United States Patent [19]

Ortega et al.

[11] Patent Number: 5,431,986

[45] Date of Patent: Jul. 11, 1995

[54] SPUNBONDED NONWOVEN NYLON FABRICS

[75] Inventors: Albert E. Ortega; J. Don Edgar; R. Wayne Thomley, all Pensacola; Robert A. Butler, Navarre, all of Fla.; Charles F. Shafer, Stockton, Ala.; William T. Gill, Pensacola, Fla.

[73] Assignee: Cerex Advanced Fabrics, L. P., Cantonment, Fla.

[21] Appl. No.: 276,693

[22] Filed: Jul. 18, 1994

[51] Int. Cl.[6] ..... B32B 27/14

[52] U.S. Cl. ..... 428/198; 156/167; 156/229; 156/296; 156/308.2; 264/176.1; 428/288; 428/296

[58] Field of Search ..... 264/176.1; 156/167, 156/229, 296, 308.2; 428/198, 288, 296

[56] References Cited

U.S. PATENT DOCUMENTS

| | | | |
|---|---|---|---|
| 3,344,013 | 9/1967 | Fahrbach | 161/150 |
| 3,853,659 | 12/1974 | Rhodes | 156/181 |
| 4,168,195 | 9/1979 | Anderson et al. | 156/181 |
| 4,729,923 | 3/1988 | Windley | 428/372 |
| 5,155,178 | 10/1992 | Windley | 525/432 |
| 5,202,178 | 4/1993 | Turner | 428/287 |

*Primary Examiner*—James J. Bell

*Attorney, Agent, or Firm*—Bell, Seltzer, Park & Gibson

[57] ABSTRACT

Spunbonded nonwoven nylon fabrics are formed from a blend of nylon 6 and nylon 6,6 polymers. A blend or copolymer of 0.1 to 10 percent by weight of nylon 6, balance nylon 6,6 is extruded into continuous filaments, pneumatically attenuated and drawn, and deposited onto a collection surface forming a web. The web is bonded either chemically or thermally. The fabric exhibits improved filament bonding. The addition of nylon 6 also improves the spinning performance of a nylon 6,6 spunbonded nonwoven process.

12 Claims, 2 Drawing Sheets

SPUNBONDED NONWOVEN NYLON FABRICS

FIELD OF THE INVENTION

This invention relates to spunbonded nonwoven nylon fabrics and processes for producing the fabrics. More specifically, the invention relates to spunbonded nonwoven nylon fabrics having improved bonding properties and processes for producing such fabrics which exhibit improved spinning.

BACKGROUND OF THE INVENTION

Spunbonded nonwoven fabrics formed of nylon 6,6 are widely used commercially for a number of purposes. Such fabrics exhibit excellent strength and permeability properties and accordingly are desirable for use in construction fabrics, filtration material, and furniture and bedding backing materials.

The fabrics are produced via the well-known spunbonding process in which molten nylon 6,6 is extruded into filaments, and the filaments are attenuated and drawn pneumatically and deposited onto a collection surface to form a web. The filaments are bonded together to produce a strong coherent fabric. Filament bonding is typically accomplished either thermally or chemically, i.e., autogenously. Thermal bonding is accomplished by passing the web of filaments between the nip of a pair of cooperating heated calender rolls. In autogenous bonding, the web of filaments is transported to a chemical bonding station or "gas house" which exposes the filaments to an activating agent (i.e., HCl) and water vapor. Water vapor enhances the penetration of the HCl into the filaments as they have a high moisture affinity. The HCl causes the filaments to become tacky and thus amenable to bonding. Upon leaving the bonding station, the web passes between rolls which compact and bond the web. Adequate bonding is necessary to minimize fabric fuzzing (i.e., the presence of unbonded filaments) and to impart good strength properties to the fabric. Autogenous bonding has been especially used in forming spunbonded nylon 6,6 industrial fabrics.

In autogenous bonding, the effectiveness of the bonding operation can be adversely affected by certain process variations, resulting in variations in such properties as abrasion resistance (fuzzing) or fabric strength. For example, slight changes in HCl and water vapor content will have a significant affect on the degree of filament bonding. U.S. Pat. No. 3,853,659 to Rhodes addresses this problem and provides a process for autogenously bonding continuous nylon filaments in which water vapor and HCl amounts were optimized to improve fabric bonding. In spite of these efforts, Rhodes suggests that control of these variables can be difficult. For example, if the moisture level is too high and condensate deposits on the fiber surface, the fibers will disintegrate, since HCl is a known solvent for nylon. On the other hand, at certain low humidity levels, water evaporation from the fibers will cause them to loose their surface tackiness and not adhere adequately to one another. As a result, the fabric will display poor abrasion resistance and poor strength properties.

A number of uncontrolled factors also sometimes adversely affect the formation and attenuation of the nylon filaments for the spunbond fabric. For example, variations in polymer properties, such as crystallinity, can adversely affect extrusion and attenuation, resulting in filament breakage, poor filament deposition, hanging of filaments in the attenuator, plugging of the attenuator, and other problems. These difficulties can cause substantial loss in fabric yield along with nonuniformities in the fabric. These problems can sometimes be alleviated by altering the temperature at which the fibers are melt spun. However, one severe drawback of this solution is that it often takes several hours for the extruder and piping to reach its new temperature and to become stabilized at the new spinning conditions. During this time, large quantities of unacceptable fabric may be produced.

SUMMARY OF THE INVENTION

The present invention addresses the foregoing problems and provides several improvements in the formation of spunbonded nylon fabrics. The present invention improves the spinnability and processability of the nylon filaments so as to improve fabric yields and minimize poor quality fabric production. Adverse effects resulting from variations in the nylon polymer properties are thus minimized. The present invention also significantly improves the bonding of the filaments, thereby enhancing fabric properties such as abrasion resistance, tensile strength and burst strength.

These improvements are achieved in accordance with the present invention by adding a small amount of nylon 6 to the nylon 6,6 feed material used in producing the spunbond fabric. More specifically, the fabric is produced by forming a blend of nylon 6 and nylon 6,6, extruding the blend in the form of a plurality of continuous filaments at a temperature between 285° C. and 315° C., directing the filaments through an attenuation device to draw the filaments, depositing the filaments onto a collection surface such that a web is formed, and bonding the filaments together either autogenously or thermally to form a coherent, strong fabric. The fabric comprises between 0.1 to 10 percent by weight of nylon 6 and 90 to 99.9 percent by weight of nylon 6,6.

As a result of the improved bonding, the fabrics possess a smoother surface and improved abrasion resistance. Improvements in process spinning reduce filament crystallinity, thus minimizing filament breakage. Consequently, a higher fabric yield is obtained.

DESCRIPTION OF THE DRAWINGS

In the drawings which form a portion of the original disclosure of the invention.

DETAILED DESCRIPTION OF THE PREFERRED EMBODIMENT

In the following detailed description of the preferred embodiments of the invention, specific terms are used in describing the invention; however, these are used in a descriptive sense only and not for the purpose of limitation. It will be apparent that the invention is susceptible to numerous variations and modifications within its spirit and scope.

Figure 1:
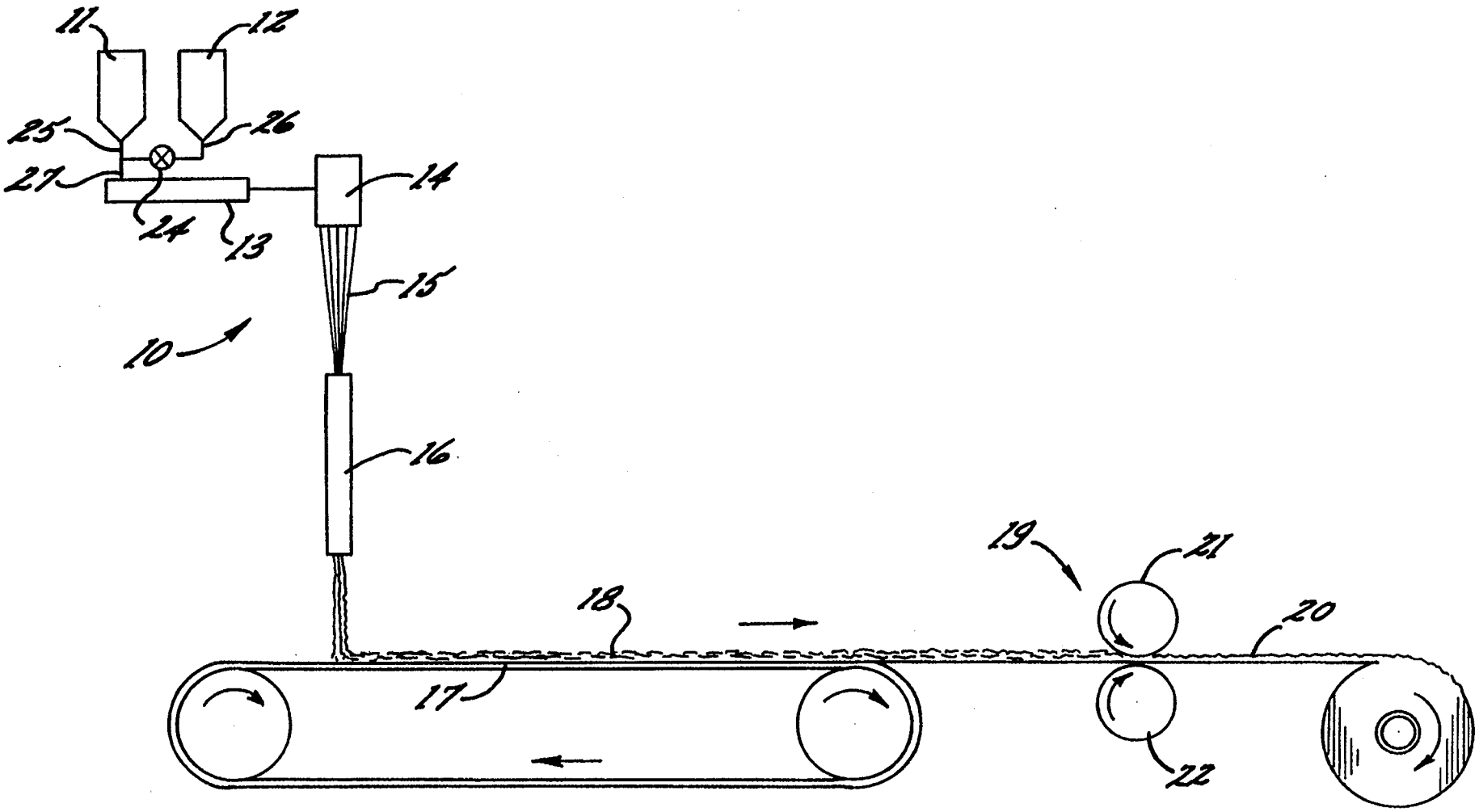
FIG. 1 is a schematic side view of a method which uses thermal bonding in the production of a spunbonded nonwoven fabric in accordance with the invention.
Figure 2:
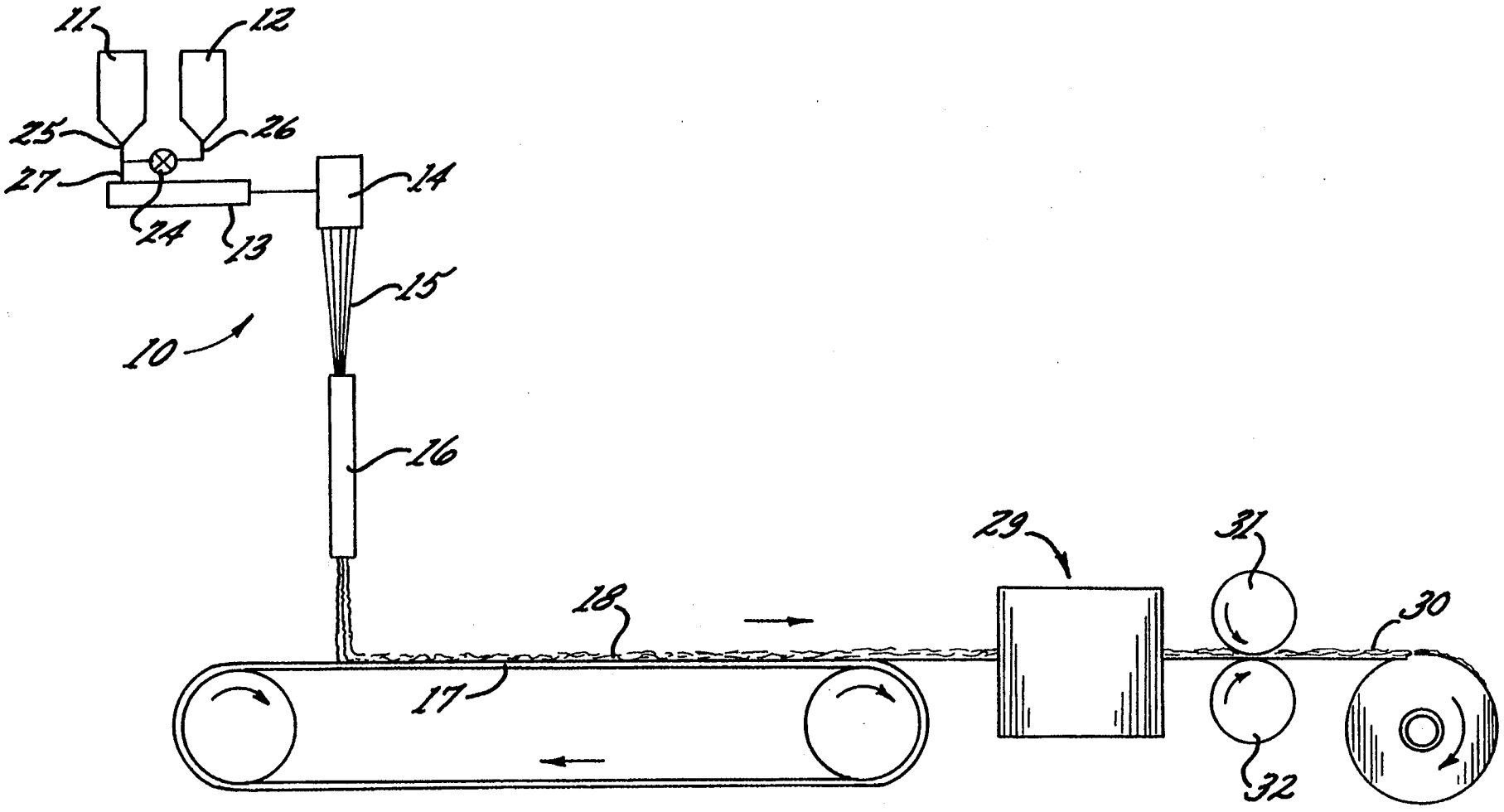
FIG. 2 is a schematic side view of a method which uses autogenous bonding in the production of a spunbonded nonwoven nylon fabric in accordance with the invention.

FIGS. 1 and 2 illustrate two types of spunbonding apparatus 10 for carrying out the process of the invention. Any of the spunbonding techniques known in the art may be used in the present invention. Exemplary spunbonding techniques are described, for example, in U.S. Pat. Nos. 4,340,563 and 4,405,297 to Appel, et al. and U.S. Pat. No. 4,692,106 to Grabowski, et al.

The apparatus shown in FIG. 1 produces a thermally bonded spunbond fabric. The apparatus includes an extruder 13 which receives granules or flakes of nylon 6,6 from a supply hopper 11, heats the polymer to a molten state, and directs the molten polymer to an extrusion block 14 where the molten polymer is extruded through the orifices of a spinneret to form fine filaments of the molten polymer. A continuous polymerization spinning system could also be used in lieu of an extruder. As the filaments move downwardly, they are contacted by a flow of quench air to cool and solidify the filaments. The filaments 15 are then directed to an attenuator device 16. In the embodiments illustrated, the attenuator device 16 comprises tube shaped venturi nozzles, sometimes referred to as Lurgi tubes. Other known attenuator devices, such as slot-shaped attenuators, may also be utilized. The filaments 15 enter the attenuator device 16 where they become entrained by large quantities of high pressure air, causing the filaments to be attenuated and drawn. The filaments emerge from the attenuator device 16 and are deposited onto a collection surface 17 forming web 18.

The web 18 is then directed along the surface to a bonding station 19 where the filaments are bonded. In the thermal bonding process shown in FIG. 1, the thermal station 19 is comprised of calender rolls 21 and 22 which heat the filaments so that they soften and become tacky, bonding the filaments to form a strong coherent fabric 20. Typically, one or both of the calender rolls is patterned, so that discrete thermal point bonds are formed in the fabric. Other thermal treatment stations known in the art may be used including, but not limited to, a through-air bonding oven and an ultrasonic welding station. Thermally bonded fabric 20 has a basis weight ranging typically from 102 to 1356 grams per square meter.

The apparatus shown in FIG. 2 is an autogenous or chemical bonding system, and differs from the apparatus shown in FIG. 1 primarily in the bonding station, which is indicated generally by reference character 29. The extruder, attenuator device and collection surface are similar to the corresponding elements in the FIG. 1 embodiment and are identified by the same reference numbers as in FIG. 1.

Chemical or autogenous bonding is achieved in bonding station 29 by activating the surface of the filaments with an activating agent (i.e., HCl) and water vapor until the filaments become tacky and bondable. The web then passes between rolls 31 and 32 which compact and further bond the web filaments. A strong, coherent fabric 30 is formed having a basis weight ranging typically from 102 to 678 grams per square meter.

In accordance with the present invention, a small amount of nylon 6 polymer is blended with the nylon 6,6 polymer used to form the spunbond filaments. Preferably, the blend or copolymer contains about 0.1 to 10 percent by weight nylon 6, balance nylon 6,6, and most preferably the blend or copolymer contains between 1 to 2 percent by weight nylon 6 and about 98 to 99 percent nylon 6,6. The addition of nylon 6 to nylon 6,6 improves the bonding of the filaments and produces a product which has a surface with improved abrasion resistance and hence less filament fuzzing. This minimizes any complications which may result in any subsequent lamination processing. Improved spinning is also realized as a result of the invention. The addition of nylon 6 to a conventional nylon 6,6 spunbonding process helps to reduce the crystallinity of the filaments. Consequentially, problems associated with spitting, hanging and attenuator plugging are all greatly reduced. A higher yield is thus obtained. Additionally, even during normal, uninterrupted operations, increases in yield are realized.

The blend or copolymer of nylon 6 and nylon 6,6 can be formed in any suitable manner. The nylon 6 and nylon 6,6 polymer are typically supplied in the form of pellets, chips, flake and the like. The desired amount of the nylon 6 pellets or chips can be blended with the nylon 6,6 pellets or chips in a suitable mixing device such as a rotary drum tumbler or the like, and the resulting blend can be introduced into the feed hopper of the conventional extruder of the spunbonding line. The blend or copolymer can also be produced by introducing the appropriate mixture into a continuous polymerization spinning system.

In the embodiments shown in FIGS. 1 and 2, the blend of nylon 6 and nylon 6,6 is obtained by metering the two polymers from separate feed hoppers into the extruder. Solid nylon 6,6 and nylon 6 are fed from feed hoppers 11 and 12 respectively. Nylon 6,6 flows through conduit 25 into the barrel of extruder 13. Nylon 6, from its hopper 12, flows through conduit 26 to a metering device 24 and thence to conduit 27. In the barrel of the extruder 13, the polymers are melted at a temperature which is preferably between 285° C. and 315° C. The range is sufficient to ensure that both polymers are above their melting point but below thermal conditions which would cause excessive volatilization of the nylon 6, as it has a lower melting point than nylon 6,6.

The following examples serve to illustrate the invention but are not intended to be limitations thereon.

EXAMPLE 1

Samples of a nylon 6/nylon 6,6 spunbonded fabric were prepared as described below. Solid pellets of nylon 6 were added to a line producing fabrics sold under the trademark "Cerex" commercially available from Fiberweb North America, Inc. The nylon 6 is known by the trademark Capron 1949F, marketed by Allied. Sufficient nylon 6 was added to the line such that a spunbonded fabric comprised about 1.6 weight percent nylon 6 with the remainder consisting of nylon 6,6. The mixture was melted and extruded at a temperature of about 300° C. The melt was spunbonded into continuous filaments and deposited onto a forming wire. The resulting web was then directed to a chemical bonding station where the web filaments were bonded using HCl gas and water vapor at a temperature of about 35° C. The web was then subjected to a roll treatment in which the web was compacted and further bonded. The degree of filament bonding was determined by the Taber abrasion method, disclosed in U.S. Pat. No. 3,853,659 to Rhodes, incorporated herein by reference. The degree of bonding increased from 4.45 for standard Cerex to 5.55 for Cerex containing nylon 6 thus producing a smoother fabric. All other physical properties were similar between fabric which contained nylon 6 and fabric that did not contain nylon 6.

EXAMPLE 2

In this example, a Fiberweb North America, Inc. manufacturing line was producing a commercial nylon 6,6 thermally bonded nylon spunbonded fabric sold under the trademark "PBN-II". The manufacturing line was similar to that illustrated in FIG. 1 with the calender rolls operating at 450° C. for thermally bonding the filaments. During a change over from a Type-32 PBN-II product (which contains flake compounded with a pigment and brightener) to a standard PBN-II product, the line was experiencing poor spinning conditions, with relatively low yields. Capron 1949-F nylon 6 was added to the line at approximately 1.3 weight percent through the feed auger normally used for introducing flake compounded with additives, with no other changes to processing conditions being made. The fabric yield improved by 85 percent subsequent to the addition. Attenuator hangs and line down time were significantly reduced.

That which is claimed is:

1. A method of producing a spunbond nonwoven fabric comprising the steps of forming a melt blend or copolymer of nylon 6 and nylon 6,6, extruding said blend or copolymer in the form of a plurality of continuous filaments, directing the filaments through an attenuator device and attenuating and drawing the filaments, depositing the filaments onto a collection surface to form a web, and bonding the filaments of the web.

2. The method according to claim 1 wherein said step of forming a melt blend or copolymer comprises maintaining the blend or copolymer at a temperature between 285° C. and 315° C.

3. The method according to claim 1 wherein said step of forming a melt blend or copolymer comprises blending about 0.1 to 10 percent by weight nylon 6 with nylon 6,6.

4. The method according to claim 1 wherein said step of forming a melt blend or copolymer comprises forming a blend of about 1 to 2 percent by weight nylon 6 and 99 to 98 percent by weight nylon 6,6.

5. The method according to claim 1 wherein the step of bonding said filaments comprises forming autogenous bonds at cross-over points of said filaments within said web.

6. The method according to claim 1 wherein the step of bonding said filaments comprises forming thermal bonds at discrete points throughout the fabric.

7. A method of producing a spunbonded nonwoven fabric comprising the steps of blending 1 to 2 percent by weight solid granular nylon 6 polymer material with nylon 6,6 solid granular polymer material, heating the blend of nylon 6 and nylon 6,6 polymer in the barrel of an extruder to a temperature between 285° C. and 315° C. to form a melt blend or copolymer of the nylon 6 and nylon 6,6, extruding said melt blend or copolymer through a spinneret to form a plurality of continuous filaments, directing the filaments into and through a pneumatic attenuator device and pneumatically attenuating and drawing the filaments, depositing the filaments onto a collection surface to form a web, and bonding the filaments of the web to form a nonwoven fabric.

8. A spunbonded nonwoven fabric comprising a plurality of continuous polymeric filaments bonded to one another to form a nonwoven web, said filaments comprising a blend or copolymer of 0.1 to 10 percent nylon 6 polymer, balance nylon 6,6 polymer.

9. A spunbonded nonwoven fabric according to claim 8, wherein said filaments comprise a blend or copolymer of 1 to 2 percent by weight nylon 6 polymer, balance nylon 6,6 polymer.

10. The spunbonded nonwoven fabric according to claim 8, wherein said fabric has a degree of bonding of greater than 5 as determined by the Taber abrasion method.

11. The spunbonded nonwoven fabric according to claim 8, wherein the filaments of said spunbonded fabric are autogenously bonded to one another at filament cross-over points.

12. The spunbonded nonwoven fabric according to claim 6, wherein the filaments of said spunbonded fabric are thermally bonded to one another at discrete points throughout the fabric.

* * * * *